United States Patent [19]

Gut et al.

[11] 4,349,231

[45] Sep. 14, 1982

[54] CHISEL ALIGNMENT UNIT FOR A CRUST BREAKING FACILITY

[75] Inventors: Edwin Gut, Steg; Erwin Arnold, Venthône; Gottfried Maugweiler; Hans Friedli, both of Steg, all of Switzerland

[73] Assignee: Swiss Aluminium Ltd., Chippis, Switzerland

[21] Appl. No.: 184,481

[22] Filed: Sep. 5, 1980

[30] Foreign Application Priority Data

Sep. 10, 1979 [CH] Switzerland ..... 8149/79

[51] Int. Cl.[3] ..... C25C 3/00

[52] U.S. Cl. ..... 299/69; 204/67; 204/245

[58] Field of Search ..... 299/37, 69, 70; 266/137; 204/67, 245; 175/84, 209, 210, 220

[56] References Cited

U.S. PATENT DOCUMENTS

| | | | |
|---|---|---|---|
| 2,666,621 | 1/1954 | Hunt | 175/84 |
| 3,681,229 | 8/1972 | Lowe | 204/245 X |
| 3,901,787 | 8/1975 | Niizeki et al. | 204/245 |
| 3,907,264 | 9/1975 | Desaar | 266/137 X |
| 4,049,529 | 9/1977 | Golla | 204/245 X |

*Primary Examiner*—Ernest R. Purser

*Attorney, Agent, or Firm*—Bachman and LaPointe

[57] ABSTRACT

The invention relates to a chisel alignment unit for a facility for breaking the crust of solidified electrolyte on an electrolytic cell, in particular on a cell for producing aluminum. A mechanically stable alignment box extends from the under side of the chisel in its non-working position to the piston rod. The chisel features at least one vertical alignment surface which is in contact with at least one alignment roll mounted on the alignment box by means of roller bearings. A wiper for removing electrolyte from the chisel is mounted below the alignment rolls and extends over the full width of the alignment surface or surfaces.

11 Claims, 2 Drawing Figures

CHISEL ALIGNMENT UNIT FOR A CRUST BREAKING FACILITY

BACKGROUND OF THE INVENTION

The present invention relates to a chisel alignment unit for a facility used to break the crust of solidified electrolyte on an electrolytic cell, in particular on a cell for producing aluminum.

In the manufacture of aluminum from aluminum oxide the latter is dissolved in a fluoride melt made up for the greater part of cryolite. The aluminum which separates out at the cathode collects under the fluoride melt on the carbon floor of the cell; the surface of this liquid aluminum acts as the cathode. Dipping into the melt from above are anodes which, in the conventional reduction process, are made of amorphous carbon. As a result of the electrolytic decomposition of the aluminum oxide, oxygen is produced at the carbon anodes; this oxygen combines with the carbon in the anodes to form $CO_2$ and CO. The electrolytic process takes place in a temperature range of approximately 940°-970° C.

The concentration of aluminum oxide decreases in the course of the process. At an $Al_2O_3$ concentration of 1-2 wt.% the so-called anode effect occurs producing an increase in voltage from e.g. 4-4.5 V to 30 V and more. Then at the latest the crust must be broken open and the concentration of aluminum oxide increased by adding more alumina to the cell.

Under normal operating conditions the cell is fed with aluminum oxide regularly, even when no anode effect occurs. Also, whenever the anode effect occurs the crust must be broken open and the alumina concentration increased by the addition of more aluminum oxide, which is called servicing the cell.

For many years now servicing the cell includes breaking open the crust of solidified melt between the anodes and the side ledge of the cell, and then adding fresh aluminum oxide. This process which is still widely practiced today is finding increasing criticism because of the pollution of the air in the pot room and the air outside. In recent years therefore it has become increasingly necessary and obligatory to hood over or encapsulate the reduction cells and to treat the exhaust gases. It is however not possible to capture completely all the exhaust gases by hooding the cells if the cells are serviced in the classical manner between the anodes and the side ledge of the cells.

More recently therefore aluminum producers have been going over to servicing at the longitudinal axis of the cell. After breaking open the crust, the alumina is fed to the cell either locally and continuously according to the point feeder principle or discontinuously along the whole of the central axis of the cell. In both cases a storage bunker for alumina is provided above the cell. The same applies for the transverse cell feeding proposed recently in U.S. Pat. No. 4,172,018.

The breaking open of the solidified electrolyte is carried out with conventional, well known devices fitted with chisels which are rectangular or round in cross section.

These chisels tend to rotate as they are pushed through the hard crust of solidified electrolyte.

Various devices which are described in technical literature are aimed at preventing the rotation of chisels which are rectangular in cross section e.g.

(a) An alignment device in the pressure cylinder, without centering rolls, for a crust breaker with small displacement distances.

(b) An alignment device in the pressure cylinder and the same again below this, which constitutes therefore a so-called double alignment unit.

(c) An alignment device for the piston rod.

The known forms of alignment device have the disadvantage that both the device and the chisel have to be somewhat massive in design which causes difficulty and awkwardness in their use. Also, there is the danger that the bearing to prevent rotation becomes worn due to the alumina particles which enter that part. The proper functioning of the bearings is then affected.

SUMMARY OF THE INVENTION

It is therefore an object of the invention to develop an alignment unit for aligning and guiding the chisel of a crust breaker used to break open the solidified crust of electrolyte on a reduction cell, such that the chisel, in spite of the simple and relatively light construction of the unit is prevented from rotating and that the unit exhibits a long service life with little susceptibility to breaking down.

This object is achieved by way of the invention which is characterised by way of:

(a) a mechanically stable alignment box, extending from the under side of the chisel in its non-working position to the piston rod, (b) a chisel which features at least one flat, vertical alignment surface, (c) at least one alignment roll which is secured to the alignment box via roller bearings and engages the alignment surface, and (d) an electrolyte wiper which is mounted on the alignment box, below the alignment rolls, and extends across the whole width of the alignment surface or surfaces.

The alignment box is made of solid steel sheet which is for example 2-3 mm thick and provides therefore the mechanical stability required of such a unit.

BRIEF DESCRIPTION OF THE DRAWINGS

A special version of the invention is shown schematically in the drawings viz..

DETAILED DESCRIPTION

Figure 1:
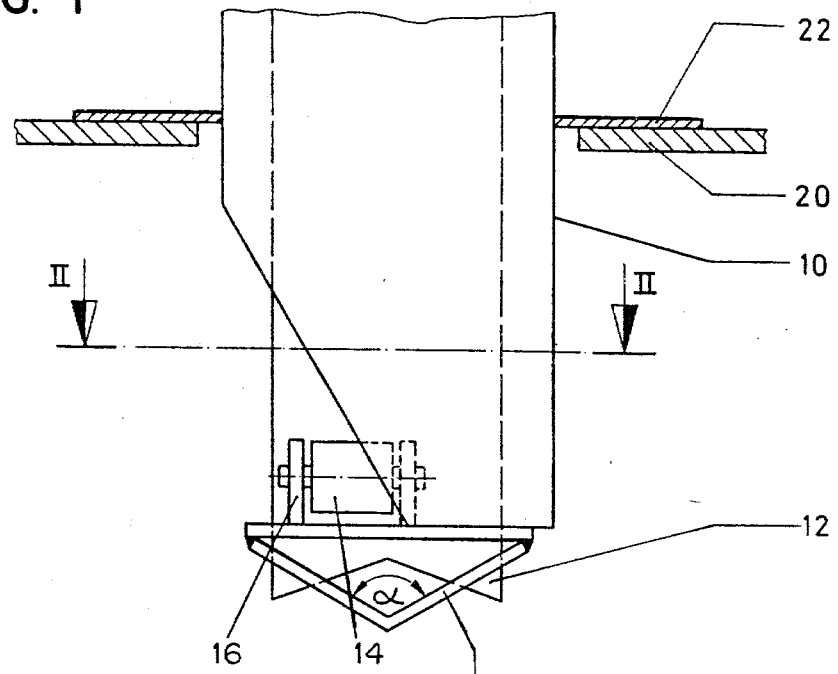
FIG. 1: A vertical, longitudinal section of a crust breaking facility in the stationary position, shown with view through part of the lower part of the facility, and its alignment holder for the chisel.
Figure 2:
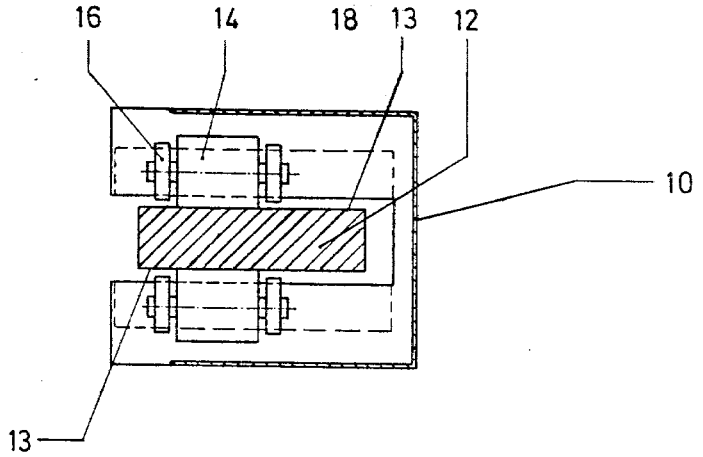
FIG. 2: A horizontal section along II—II in FIG. 1.

In a preferred version the alignment box can, apart from its lower side which has the opening for the chisel, be made air-tight. In hooded cells the alignment box, in a first version, penetrates the hooding over the cell so that only its air-tight part projects out. The top sheet of the box is in turn penetrated by the piston rod which pushes the chisel down to break open the crust. This penetration of the alignment box top is however also air-tight. In a second version the alignment box, also called the alignment housing, is flanged onto the lower side of the pressure cylinder. According to a further version the cell covering can also be the top sheet of the alignment box.

The alignment rolls are preferably wear resistant metallic castings e.g. cast steel or grey cast iron. These are mounted on a roller bearing without ball bearings or the like. The alignment rolls which preferably have a diameter of some centimeters do not lie directly on the alignment surface of the chisel; they have a little play of $<1$ mm.

In principle the design and arrangement of the alignment roll or rolls, depending on the chisel to be aligned, can be such as best suits the situation in question.

If a chisel has only one vertical alignment surface e.g. such as is the case with chisels with semi-circular cross section, then only one roll which extends over the whole of the alignment surface or two smaller rolls at the ends of this alignment surface can be employed. This can however prevent only a rotation of the chisel but not a sideways displacement of the same.

It is useful therefore, in particular in the case of chisels with small cross section, to provide two parallel, flat alignment surfaces in the vertical direction, so that a pair of counterfacing rolls or two pairs of rolls at the ends of the alignment surfaces can prevent rotation and sideways displacement of the chisel. If a pair of rolls is provided in the middle of the alignment surfaces, these rolls extend over the greater part of the width of the alignment surfaces.

Independent of the number and position of the alignment rolls, their longitudinal axis always lies horizontal. This longitudinal axis lies preferably in the same horizontal plane in the lowest part of the alignment box.

On drawing the chisel back from the working position into the stationary position solidified electrolyte is pulled up on the chisel. To prevent this crust coming between the chisel and the alignment roll or rolls a wiper is provided on the under side of the alignment box and extends over the whole of the alignment surface or surfaces. The lower edge of the wiper, which lies against the alignment surface or surfaces and has less play than the alignment rolls, is preferably not horizontal, but is e.g. inclined or V-shaped.

Preventing the rotation or sideways displacement of chisels of small cross section, which can be employed with large piston movement only when stably positioned in accordance with the invention, is of great importance as this allows change over to central feed or point feed of alumina in existing cells without requiring much change in anode spacing along the central axis of the cell.

The crust breaker facility which comprises in principle pressure cylinder, piston rod, chisel and alignment box is mounted directly or indirectly on the cell superstructure or is a component part of a servicing vehicle or cell manipulator.

The stability of the chisel holder with its alignment box in accordance with the invention is, compared with known piston alignment units, much less complicated and more effective.

Referring specifically to the drawings, FIG. 1 shows a block-shaped alignment box 10 made of steel sheet. The chisel 12, in this case a fish-tail-shaped chisel, passes through this box 10. Two, opposite lying, parallel alignment surfaces 13, the larger faces of the chisel which is rectangular in cross section, are in contact with a pair of alignment rolls 14 positioned at the sides of the chisel. The relatively massive construction of the chisel 12 prevents the other sides of the chisel i.e. these not in contact with the rolls, from being deflected out of line. According to another version, not shown here, a further pair of rolls can be provided on the other sides, or the alignment rolls, preferably positioned in the middle, extend over a larger part of the chisel width.

The roller bearings 16 are secured to the upper side of the base sheet of the alignment box e.g. by welding.

On the under side of the base sheet there is a wiper 18 for removing electrolyte from the chisel. This wiper which extends over the whole width of the alignment surfaces prevents residual solidified electrolyte, which adheres to the chisel as it is raised, from coming between the rolls and the alignment surface. No wipers are provided on the narrow sides of the chisel 12.

As viewed in the longitudinal section, the wiper 18 is V-shaped, the angle $\alpha$ being preferably between 90° and 150°.

The alignment box penetrates the covering 20 over the cell; gaskets 22 are provided to ensure more effective sealing in of the exhaust gases.

What is claimed is:

1. Chisel alignment unit for a facility to break open the crust of solidified electrolyte on an electrolytic cell which comprises:

(a) a chisel having at least one flat, vertical alignment surface and an underside;

(b) a mechanically stable alignment box extending from the underside of the chisel in its non-working position wherein said chisel passes through said alignment box;

(c) at least one alignment roll having a horizontal longitudinal axis secured to the alignment box and engaging the alignment surface; and (d) an electrolyte wiper mounted on the alignment box below the alignment rolls and extending across the whole width of said alignment surface and operative to prevent the crust from coming between the chisel and alignment roll, wherein said unit is operative to align and guide said chisel and prevent rotation thereof.

2. Chisel alignment unit according to claim 1 wherein the alignment box is air-tight, and said unit passes through a cell hood which is made air-tight by a sealing plate or gasket.

3. Chisel alignment unit according to claim 1 wherein the chisel features two parallel alignment surfaces and, with a play of $<1$ mm, at least one pair of facing alignment rolls engaging these alignment surfaces.

4. Chisel alignment unit according to claim 3 wherein a pair of alignment rolls is positioned on one side of the alignment surfaces.

5. Chisel alignment unit according to claim 3 wherein a pair of alignment rolls is provided on both alignment surfaces.

6. Chisel alignment unit according to claim 3 wherein a pair of alignment rolls extending over the greater part of the width of the chisel are positioned in the middle of the alignment surfaces.

7. Chisel alignment unit according to claim 1 wherein the lower edge of the electrolyte wiper is inclined.

8. Chisel alignment unit according to claim 1 wherein the lower edge of the electrolyte wiper is V-shaped with an angle ($\alpha$) of 90°–150°.

9. Chisel alignment unit according to claim 1 wherein said alignment roll is secured to the alignment box via roller bearings.

10. Chisel alignment unit according to claim 1 for a cell for the production of aluminum.

11. Chisel alignment unit according to claim 1 wherein the longitudinal axis of the alignment roll lies in the same horizontal plane in the lowest part of the alignment box.

* * * * *